US006243972B1

(12) United States Patent
De France

(10) Patent No.: US 6,243,972 B1
(45) Date of Patent: Jun. 12, 2001

(54) SOFT BOOT FOR A GLIDING SPORT

(75) Inventor: Guillaume De France, Tullins (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/436,665

(22) Filed: Nov. 10, 1999

(30) Foreign Application Priority Data

Nov. 26, 1998 (FR) ..... 98 15088

(51) Int. Cl.[7] ..... A43B 5/04; A43B 5/16; A63C 9/10; A63C 9/18

(52) U.S. Cl. ..... 36/117.1; 36/117.3; 36/117.4; 36/115; 280/624; 280/625

(58) Field of Search ..... 36/114, 115, 116, 36/117.1, 117.3, 117.4, 119.1, 131, 30 R, 117.5, 117.2, 31; 280/613, 623, 624, 625, 634

(56) References Cited

U.S. PATENT DOCUMENTS

| | | | | |
|---|---|---|---|---|
| 3,807,062 | | 4/1974 | Spier . | |
| 3,957,280 | * | 5/1976 | Turnheim et al. | 36/117.1 |
| 5,474,322 | * | 12/1995 | Perkins et al. | 36/117.1 |
| 5,669,630 | | 9/1997 | Perkins et al. . | |
| 5,775,009 | * | 7/1998 | Marega et al. | 36/117.5 |
| 5,815,952 | * | 10/1998 | Bobrowicz | 36/117.3 |
| 5,875,566 | * | 3/1999 | Bourdeau et al. | 36/117.1 |
| 5,887,886 | | 3/1999 | Bourdeau . | |
| 5,938,228 | * | 8/1999 | Bourdeau | 280/613 |

FOREIGN PATENT DOCUMENTS

| | | |
|---|---|---|
| 0645101A | 3/1995 | (EP) . |
| 2 722 371A | 1/1996 | (FR) . |
| 2 743 700 | 7/1996 | (FR) . |
| WO 97 26959A | 7/1997 | (WO) . |
| WO 9830292 | 7/1998 | (WO) . |

OTHER PUBLICATIONS

French Preliminary Search Report in SN 9815088—France.

* cited by examiner

*Primary Examiner*—Paul T. Sewell
*Assistant Examiner*—Anthony Stashick
(74) *Attorney, Agent, or Firm*—Bughnion S.A.; John Moetteli

(57) ABSTRACT

A boot for a gliding sport, consisting of a bootie with a soft upper (1) and of an intermediate rigid sole (4) itself at least partially covered by a flexible walking sole (9), and provided with a transverse metal bar (6) for connection to a binding. The boot further has bearing surfaces on either side of the bar. At least in the foot sole region, the bearing surface is a projection (7) of the intermediate rigid sole.

10 Claims, 1 Drawing Sheet

Fig.1
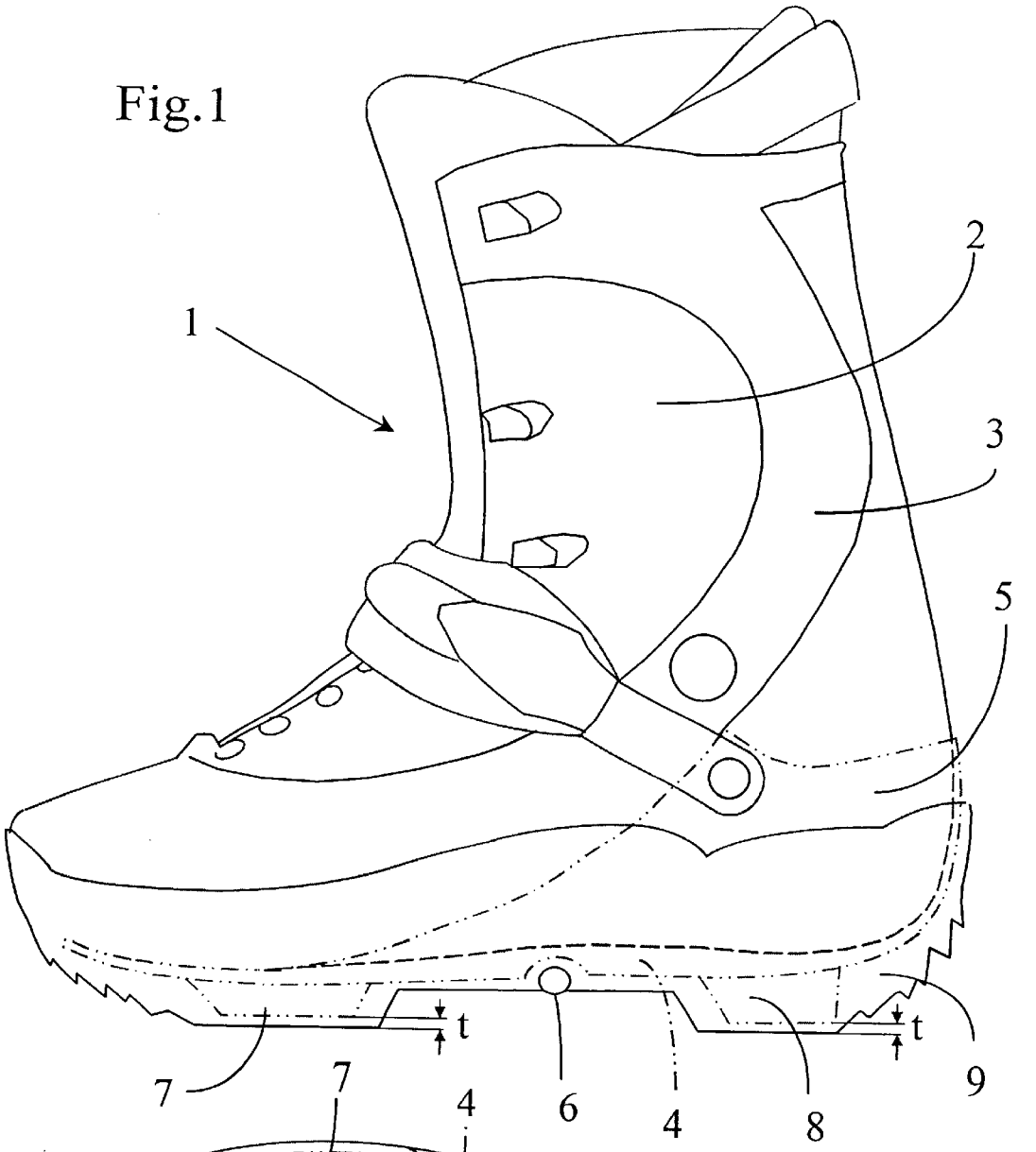
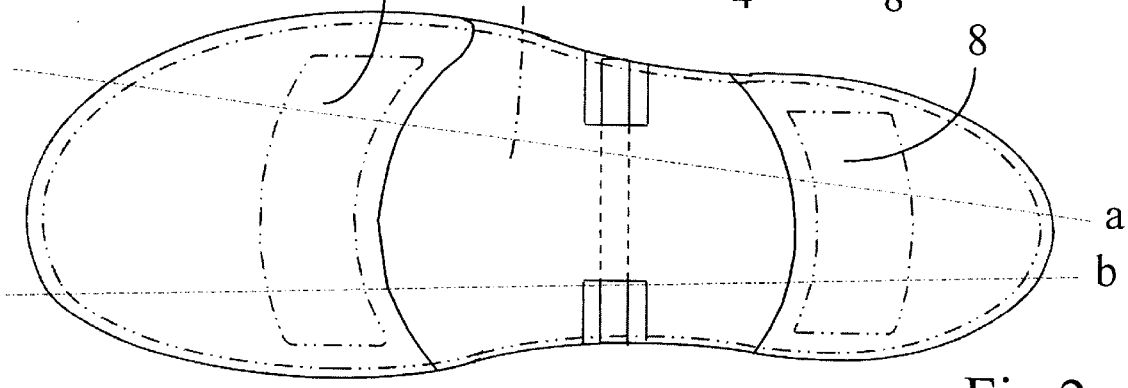
Fig.2

SOFT BOOT FOR A GLIDING SPORT

BACKGROUND OF THE INVENTION

The invention relates to a boot for a gliding sport, for example for snowboarding, consisting of an inner boot with a soft upper and of an intermediate rigid sole itself at least partially covered by a flexible walking sole, in which the intermediate rigid sole, on the one hand, is provided with means for connection to a binding and, on the other hand, has bearing surfaces on either side of the binding component.

Such a boot is disclosed by U.S. Pat. No. 5,887,886 the content of which is incorporated by reference. In this boot, the binding component consists of a bar which is arranged at the center of the sole, under the region of the arch of the foot, and directed longitudinally. On each side of this bar, the rigid sole has concave bearing faces intended to bear on convex faces, of conjugate shape, of the binding. The boot is therefore held on the binding only in the central region of the sole, over a relatively short length. In order to ensure good stability of the boot, the respectively concave and convex surfaces need to be matched perfectly. The drawback with this device is the difficulty of engaging the boot in the binding. Indeed, if the sole of the boot and/or the binding have snow stuck to them, it is impossible to engage the boot. The flexible walking sole is divided into two parts, extending respectively under the heel and under the sole of the foot. This choice makes it easier to walk but at the cost of the loss in technical performance of the boot. This is because it is difficult to set the snowboard on its edge and therefore engage turns, in particular front turns, due to the forces being exerted on the binding, caused by the fact that the front of the boot can flex.

Patent FR 2 743 700, the content of which is incorporated by reference, discloses a boot for a gliding board provided with rigid bearing surfaces located respectively in the heel region and in the sole region of the foot. These rigid bearing surfaces, of which there are four, are obtained by recesses in the sole, into which recesses projections of the binding penetrate. This design has the object of separating the contact of the boot on the binding from the contact of the boot on the ground, that is to say making the contact on the binding independent of the wear on the walking sole. The intended object is therefore different from the object intended to be achieved by the boot according to the invention.

The applicant markets a snowboarding boot provided with two lateral pins in its central region for fixing it in a snowboard binding of the "EMERY"-type (registered trademark). Such a binding method makes it possible to obtain good lateral holding without a lateral bearing surface of the boot according to the cited prior art. This boot available on the market is provided with a relatively thick elastic walking sole. When the boot is fixed on the snowboard, it is to some extent fixed, in its central zone, around a transverse axis and bears on the gliding board via the heel and the sole of the foot. In view of the elasticity of the walking sole, the boot has a tendency to swivel about its binding axis when changing weight, in particular on the front of the foot during front turns. Although small, this elastic play reduces the accuracy with which the snowboard is controlled and lengthens the response time of the board. Therefore, what is needed is a snowboard boot which overcomes this drawback.

SUMMARY OF THE INVENTION

To that end, the intermediate rigid sole of the boot according to the invention, which is provided with means for connection to a binding, has at least one bearing surface which projects under the intermediate rigid sole and is located in the foot sole region.

The intermediate rigid sole preferably has two bearing surfaces located respectively in the foot sole region and in the heel region.

These bearing surfaces, which will generally be covered only with a thin walking sole, provide rigid bearing of the boot on the gliding board or on a plate bearing the binding, so that the boot can no longer tilt. Further, in the case of a snowboard, on which the boot is oriented obliquely relative to the axis of the snowboard, since the bearing zones are located to the front and to the rear of the boot, the points of application of the forces are close to the edges of the snowboard and are therefore more capable of allowing the snowboard to tilt on its edge. This makes turning easier, for example front turning.

The bearing surfaces preferably consist of transverse ribs which allow not only front/back pressure but also lateral pressure.

These ribs could consist of separately attached parts, fixed, for example, by adhesive bonding to the rigid sole.

The binding used will preferably be a binding which takes up the play due to the wear on the sole, so that the wear on the thin walking sole optionally covering the ribs or the wear on a rib itself is of no consequence. In the case where the means for connecting the boot to the snowboard binding consists of two opposite pins located in the central zone of the sole, the bearing surfaces are located at a relatively large distance from the fixing pins, which further increases the rigidity of the binding of the boot to the gliding board.

The rigid sole is preferably in the shape of a cradle, starting from the heel, over the majority of its length, in which cradle the soft upper of the boot is fixed.

BRIEF DESCRIPTION OF THE DRAWING(S)

The appended drawing represents an embodiment of the invention by way of example.

FIG. 1 is a side view of the boot in which the intermediate rigid sole has been represented by a phantom line in a through-view.

FIG. 2 is a bottom view of the intermediate rigid sole, (in phantom) with the fixing pins.

DETAILED DESCRIPTION OF THE PREFERRED EMBODIMENTS

The boot which is represented comprises an upper 1 in the form of a soft bootie which, in the known way, has zones 2 of woven material and zones, such as 3, made of flexible plastic. This bootie is fixed on an intermediate rigid sole 4 which is raised at the rear and on the sides, over the majority of the length of the sole, so as to form a kind of cradle 5 in which the upper 1 is engaged. Under the intermediate rigid sole 4, in its central zone, a transverse metal bar 6 is fixed which projects laterally on each side of the sole so as to form two lateral pins for fixing the boot in a snowboard binding of the "EMERY"-type. The intermediate rigid sole 4 is provided with two transverse ribs 7 and 8 which are located respectively under the sole of the foot, in the metatarsophalangeal zone and under the heel. These ribs 7 and 8 are relatively wide and have a trapezoidal profile. Seen in plan, they are also arced around the center of the sole.

The intermediate rigid sole 4 is coated, by overmolding, with a walking sole 9 which also covers the bottom and a part of the periphery of the upper 1. This walking sole 9 is, for example, made of thermoplastic rubber known by the trade abbreviation TPR. The walking sole 9, which is relatively thick to the front and to the rear of each of the ribs 7 and 8, covers these ribs 7 and 8 with a thin layer t. This thin layer t has virtually no effect on the rigidity with which the ribs 7 and 8 bear on the snowboard and the binding plate, respectively. The ribs 7 and 8 could be flush with the walking sole 9.

The invention is not of course limited to the embodiment described above. In particular, the bearing surfaces could have different shapes. They could be made of different materials. One could be more rigid than the other. Further, they could be separately attached to the intermediate rigid sole 4 by bonding or fastening.

The ribs could each be replaced by projections close to each side edge of the sole, in which the portion of the ribs 7, 8 between lines a and b of FIG. 2 do not project (thus defining four projections).

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A boot for a gliding sport including a binding, the boot comprising a bootie with a soft upper (1) and an intermediate rigid sole (4) at least partially covered by a flexible walking sole (9), in which the intermediate rigid sole is provided with means (6) for connection to a central region of the binding and has at least one ground bearing surface (7, 8) which downwardly projects from the intermediate rigid sole and is substantially spaced apart from the central connection means, the flexible walking sole providing ground contact surfaces not supported by the projecting, ground bearing surfaces of the rigid sole.

2. The sports boot as claimed in claim 1, wherein the intermediate rigid sole has at least two bearing surfaces (7, 8) at least two of which are located on opposite sides of the central connection means (6).

3. The sports boot as claimed in claim 1, wherein the at least one bearing surface (7, 8) is in the form of ribs.

4. The sports boot as claimed in claim 1, wherein the intermediate sole is provided with two coaxial lateral pins (6) for connecting it to the binding.

5. The sports boot as claimed in claim 1, wherein the at least one bearing surface (7, 8) is formed by separately attached elements.

6. The sports boot as claimed in claim 1, wherein at least two bearing surfaces are provided of different shapes.

7. The sports boot as claimed in claim 2, wherein the bearing surfaces are made of different materials.

8. The sports boot as claimed in claim 2, wherein one of the bearing surfaces (7, 8) is more rigid than the other.

9. The sports boot as claimed in claim 1, wherein the walking sole (9) also covers the at least one bearing surface (7, 8).

10. The sports boot as claimed in claim 1, wherein the intermediate rigid sole (4) is in the shape of a cradle (5) over the majority of its length, in which cradle the bootie is fixed.

* * * * *